US005893229A

United States Patent [19]

Werner

[11] Patent Number: 5,893,229

[45] Date of Patent: Apr. 13, 1999

[54] DEVICE FOR FRAMING PICTURES, CERTIFICATES AND THE LIKE

[76] Inventor: Richard S. Werner, 326 Cedar Sauk Rd., West Bend, Wis. 53095

[21] Appl. No.: 08/803,037

[22] Filed: Feb. 19, 1997

[51] Int. Cl.[6] ..... G09F 7/02

[52] U.S. Cl. ..... 40/773; 40/760; 40/594

[58] Field of Search ..... 40/594, 773, 760, 40/772

[56] References Cited

U.S. PATENT DOCUMENTS

| | | | |
|---|---|---|---|
| 3,280,493 | 10/1966 | Newman . | |
| 3,341,961 | 9/1967 | Shanks . | |
| 3,687,770 | 8/1972 | Chase . | |
| 3,707,053 | 12/1972 | Itano . | |
| 3,797,152 | 3/1974 | Brandt . | |
| 3,987,569 | 10/1976 | Chase . | |
| 4,225,369 | 9/1980 | Felchlin | 40/611 X |
| 4,378,647 | 4/1983 | Stancato . | |
| 4,741,119 | 5/1988 | Baryla . | |
| 4,777,746 | 10/1988 | Brooks . | |
| 4,807,807 | 2/1989 | Glick . | |
| 4,809,451 | 3/1989 | Suzuki . | |
| 4,914,842 | 4/1990 | Lieberman . | |
| 5,025,581 | 6/1991 | Polzin . | |
| 5,074,593 | 12/1991 | Grosso . | |
| 5,161,827 | 11/1992 | Grosso . | |
| 5,248,536 | 9/1993 | DuKatz . | |
| 5,269,084 | 12/1993 | Best et al. . | |
| 5,279,692 | 1/1994 | Best et al. . | |
| 5,328,729 | 7/1994 | Lamonte, Jr. . | |
| 5,364,671 | 11/1994 | Gustafson . | |

FOREIGN PATENT DOCUMENTS

| | | | |
|---|---|---|---|
| 2269261 | 2/1994 | United Kingdom | 40/584 |

*Primary Examiner*—Cassandra H. Davis

*Attorney, Agent, or Firm*—Jansson, Shupe, Bridge & Munger, Ltd.

[57] ABSTRACT

A device and method for framing articles such as photographs, certificates and the like is comprised of a sheet-like frame having a viewing side and a reverse side. Single-sided tape adheres to the reverse side of the frame and a layer of static-cling film having first and second surfaces is positioned so that the first surface is in contact with the tape. An article having a display face adheres to the second surface of the film. The device with article affixed and framed is capable of being mounted by using static-cling film, double-sided tape, or a tack, depending upon the type of surface to which the device is to be mounted. Several versions of the device and method are disclosed. Such device and method facilitate quick, inexpensive framing of photos or the like, particular when such articles are planned to be displayed more or less temporarily.

13 Claims, 4 Drawing Sheets

DEVICE FOR FRAMING PICTURES, CERTIFICATES AND THE LIKE

FIELD OF INVENTION

This invention relates generally to card, picture and sign exhibiting and, more particularly to a device and method for framing articles such as photographs, certificates and the like.

BACKGROUND OF THE INVENTION

Throughout history, people have employed various devices in order to appropriately display articles such as pictures, photographs and certificates of award or recognition. These devices include the traditional picture frame that is used for the wall mounting of articles. Such frames, usually rigid three-dimensional structures, require some form of hooking device mounted on the wall working in tandem with a wire or protrusion attached to the back of the frame, thereby enabling the frame to hang on the surface of a wall. Another type of framing device utilizes a brace that extends from the back of the frame, thereby allowing the frame to stand on a level surface such as a desk or table top.

A shortcoming of both of these framing devices is that their relative cost prevents them from being widely used to display informal candid photographs of people, pets, or scenery taken during parties, vacations, or everyday occurrences. Many such photographs are displayed on a refrigerator, filing cabinet or locker using a magnet. Such method of display offers no form of protection for the article—nor is it particularly attractive aesthetically. This lack of protection results, in many cases, in some type of disfigurement of the display either in the form of torn or curled edges or damage to the face of the article.

Another form of informal display involves putting the article beneath a glass table or desk top or the clear cover sheet of a desk blotter. Such display is limited in that the article is usually visible only to the person sitting behind the desk or table.

An inexpensive, easy-to-use device and method for framing that would allow for both the protection and display of significant numbers of candid photographs and other articles on any surface and at modest cost would be an important advancement in the art.

OBJECTS OF THE INVENTION

An object of the invention is to provide a new device for framing photographs, certificates and the like.

Another object of the invention is to provide a new method for framing photographs, certificates and the like using lower-cost materials.

Another object of the invention is to provide a new device for framing photographs, certificates and the like that can adhere to or be tacked to any surface.

Still another object of the invention is to provide a new device for framing articles such as photographs and certificates that is so modest in cost as to be disposable if, for example, such articles have been transferred to an album. How these and other objects are accomplished will become apparent from the following descriptions and from the drawings.

SUMMARY OF THE INVENTION

The invention involves a device for framing articles including photographs, certificates and the like. The device is comprised of a sheet-like frame having a viewing side and a reverse side. Single-sided tape adheres to the reverse side of the frame while a layer of static-cling film having first and second surfaces is positioned so that the first surface is in contact with the tape. Finally, an article having a display face adheres to the second surface of the film. In a specific embodiment of the invention, double-sided adhesive tape is attached to the second surface of the film, thereby enabling the device to adhere to a textured or cement surface such as a concrete block wall. In yet a more specific embodiment, a tack can be attached through the frame to enable the device to adhere to, e.g., a papered or cork surface.

In a preferred embodiment of the invention, the article being framed has a reverse face and a second layer of static-cling film is attached to the reverse face of the article. In a more specific version of the preferred embodiment, the second layer of film has a second surface and double-sided adhesive tape is attached to the second surface of the second layer of film, thereby enabling the device to adhere to a textured or cement surface.

In yet another preferred embodiment of the invention, a sheet of single-sided tape having an adhesive surface is used to form the frame. In this embodiment, a layer of static-cling film having first and second surfaces is positioned so that the first surface of the film is in contact with the adhesive surface of the tape. The article being framed is oriented so that its display face adheres to the second surface of the film. In such embodiment, the tape has a central aperture therethrough.

Another aspect of the invention involves a method for framing articles including photographs, certificates and the like. Such method includes the steps of providing (a) a sheet-like framing material having a viewing side and a reverse side, (b) a sheet of pressure-sensitive single-sided tape, (c) a sheet of static-cling film having first and second surfaces, and (d) an article having a display face. The framing of the article is accomplished by applying the tape to the reverse side of the framing material. This is followed by cutting center apertures in both the framing material and the tape. Once this is done, the first surface of the film is attached to the tape. Finally, the display face of the article is affixed to the second surface of the sheet of static-cling film.

A specific embodiment of such method includes the step of attaching a strip of double-sided tape to the second surface of the film thereby enabling the device to adhere to a textured or cement surface. In another, more specific embodiment of the method, a tack is attached through the frame to enable the device to adhere to a papered surface.

In a preferred method of framing, the sheet of static-cling film is a first sheet with a liner attached to its second side, the article has a reverse face, and the affixing step is followed by providing a second sheet of static-cling film having a first and second surface with a liner joined to the second surface of the second sheet of film. In this method, the first surface of the second sheet of cling-free film is appended to the reverse face of the article to be framed. Once this is done, the liner is then removed from the second surface of the second sheet of film.

In yet another preferred embodiment of the invention, a strip of double-sided tape can be applied to the second surface of the second sheet of film, thereby enabling the device to adhere to a textured or cement surface. In a more specific embodiment, a tack can be attached through the frame to enable the device to adhere to a papered surface.

Still another preferred method of framing includes the step of providing (a) a sheet of static-cling film having a first and a second surface, (b) a liner, and (c) an article to be framed having a display face. In this method, framing is accomplished by attaching the liner to the second surface of the film. This is followed by etching the outline of a frame on the first surface of the film and then imprinting a design or solid color on the frame. This imprinting is followed by rolling the sheet of film with the liner attached into a roll. The rolling step is followed by "paying out" the film and liner from the roll, peeling the frame away from the liner, and affixing the display face of the article to the second surface of the film. Depending upon the nature of the display site, such framing method may be followed by the step of adhering a strip of double-sided tape to the second surface of the film thereby enabling the device to adhere to a textured or cement surface. Or the user may attach a tack through the film to enable the device to adhere to cork or to a papered surface, e.g., drywall.

Another preferred method of framing articles involves providing (a) a sheet of pressure-sensitive single-sided tape, (b) a sheet of static-cling film having first and second surfaces, and (c) an article having a display face. This method involves cutting a center aperture in the tape, attaching the first surface of the film to the tape, and affixing the display face of the article to the second surface of the sheet of static-cling film. In a specific version of this embodiment, a strip of double-sided tape is attached to the second surface of the film thereby enabling the device to adhere to a textured or cement surface. In a more specific version of such embodiment, a tack is attached through the frame thereby enabling the device to adhere to a papered surface.

DETAILED DESCRIPTIONS OF THE PREFERRED EMBODIMENTS

The invention involves a device 10 for framing articles 12 including photographs, certificates and the like. Several embodiments are disclosed and it should be appreciated that such embodiments may be packaged and sold in kit form. That is, the "raw materials" for making the device are in the kit and the consumer assembles such materials along with the article 12 being framed.

Figure 1:
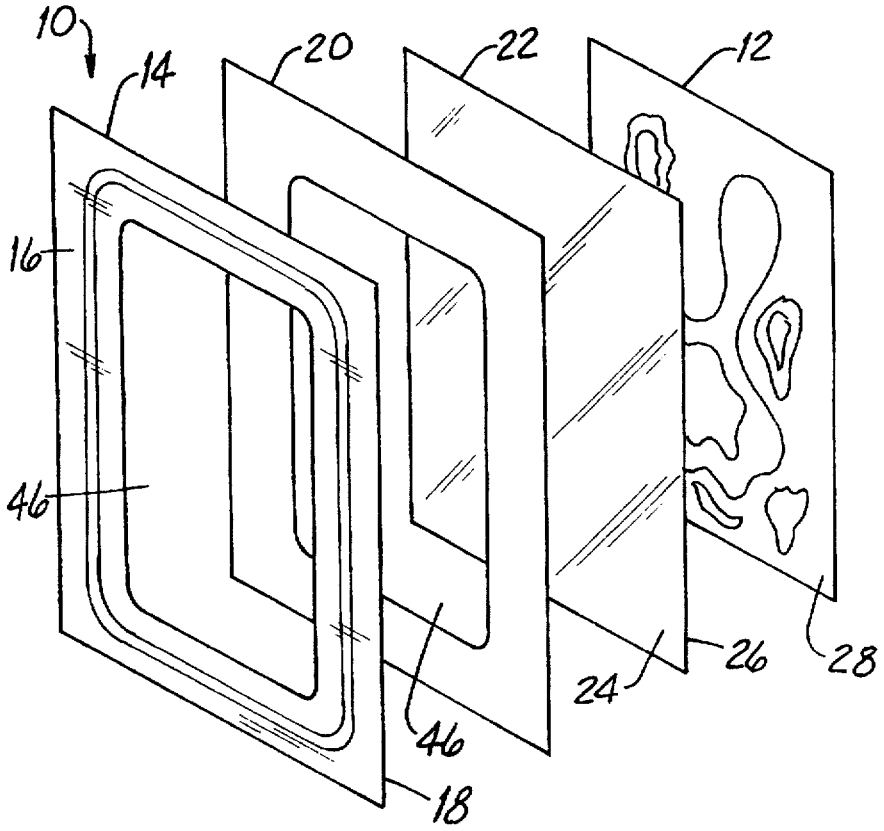
FIG. 1 is a perspective view of the device showing the viewing side of the framing material, the single-sided adhesive tape, a sheet of static-cling film, and an article to be framed.

As shown in FIG. 1, the device 10 is comprised of a substantially planar, sheet-like frame 14 having a viewing side 16 and a reverse side 18. Such frame may be made of pressed paperboard, plastic or the like. (In this specification, the terms "side," "surface" and "face" are considered synonyms and used only to provide differentiation and thereby aid understanding of the disclosure.)

Single-sided tape 20 adheres to the reverse side 18 of the frame 14 while a layer of static-cling film 22 having first and second surfaces 24, 26 is positioned so that the first surface 24 is in contact with the tape 20. Finally, an article 12 such as an candid photograph having a display face 28 adheres to the second surface 26 of the film 22. (Of course, the display face 28 of a photo, certificate or the like is that which bears an image for viewing.) The portion of the static-cling film 22 that is exposed around and beyond the edges of the article 12 allows the device 10 to adhere to and be displayed on a vertical surface made of materials such as glass, metal, or vinyl.

Figure 5:
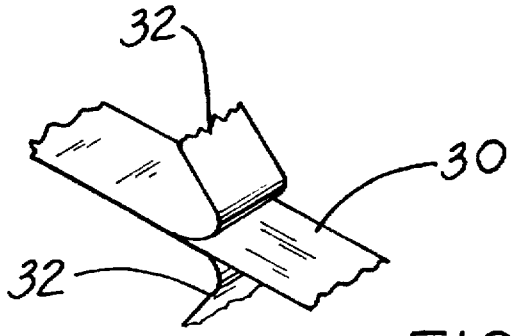
FIG. 5 is a perspective of a strip of double-sided adhesive tape showing a liner on both sides being partially peeled back.
Figure 6:
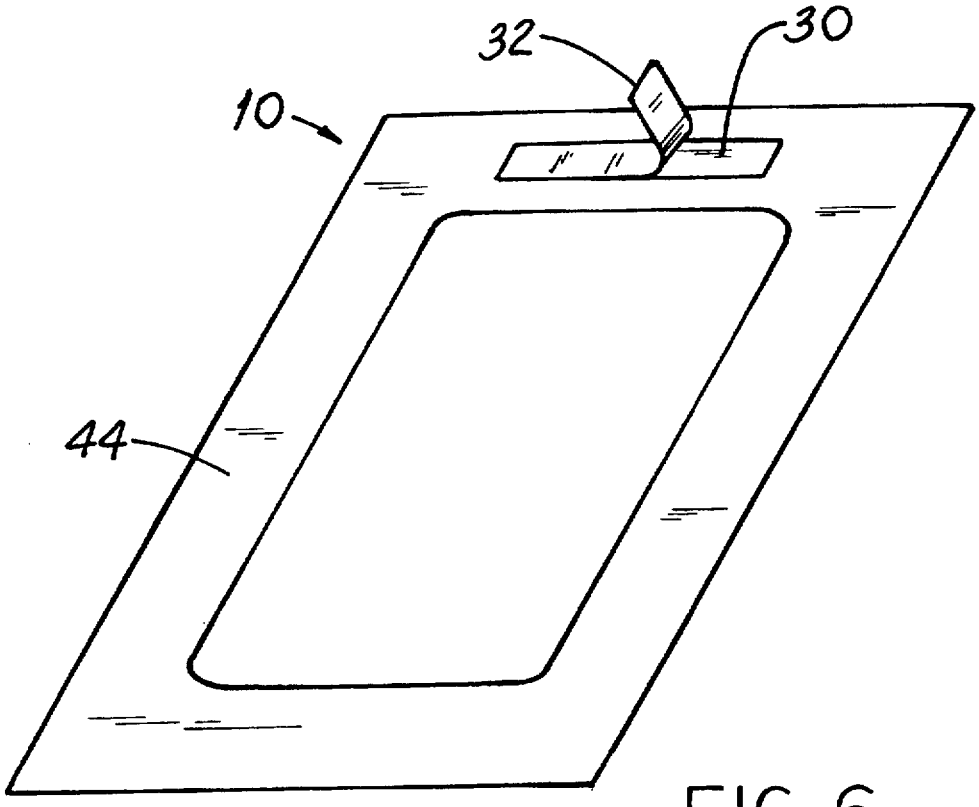
FIG. 6 is a perspective of the device showing the double-sided adhesive tape being applied to the back side.

Because static-cling film 22 does not adhere to materials such as concrete or vinyl wallpaper, a specific embodiment of the invention has a strip of double-sided adhesive tape 30 with a liner 32 (a strip covering the adhesive and pulled away when the tape is put to use), as shown in FIG. 5, on both sides. As shown in FIG. 6, upon removal of the liner 32, the double-sided adhesive tape 30 is attached to the second surface of the film 26, thereby enabling the device to adhere to a textured or cement surface such as a concrete block wall. In yet a more specific embodiment, a tack 34 (also supplied with a framing kit) can be attached through the frame 14 to enable the device 10 to adhere to, e.g., a papered or cork surface. In such an embodiment, a hole 52 may or may not be pre-drilled into the framing material.

Figure 2:
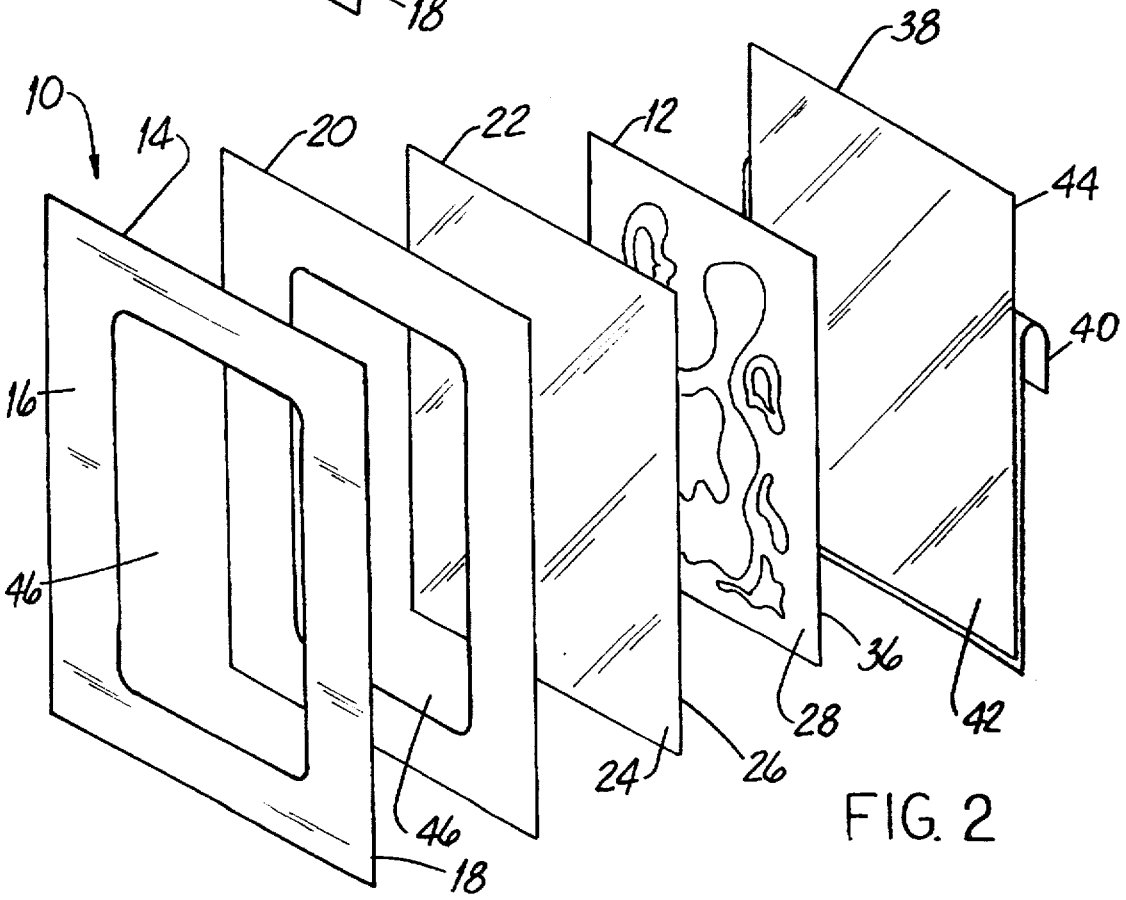
FIG. 2 is a perspective view of the device showing the same elements as FIG. 1 but with a second sheet of static-cling film behind the article to be framed.

FIG. 2 shows a preferred embodiment of the invention in which the article 12 being framed has a reverse face 36 and a second layer of static-cling film 38 is attached to the reverse face 36 of the article. In this embodiment, the second layer of static-cling film 38 has a liner 40 affixed to its second side 44. After the first side 42 of the film 38 is attached to the reverse face 36 of the article 12, the liner 40, which may be larger thane the film 38 is it is covering, is removed thereby allowing the article 12 to be displayed on a vertical glass, metal or vinyl surface.

The second sheet of static-cling film 38 is used when hanging a frame 14 or article 12 which is heavier than a conventional 3" by 5" photo, for example. By having a greater area of clinging material in contact with the mounting surface, an article 12 of relatively heavier weight can be hung on a vertical surface. As with the earlier embodiment, a more specific version of the preferred embodiment provides a strip of double-stick tape 30 having a dual liner 32. When mounting the frame 14 on a surface that does not adhere to static-cling film (i.e., concrete), the double-sided adhesive tape 30 is attached to the second surface 44 of the second layer of film 40, thereby enabling the device 10 to adhere to a textured or cement surface. In yet a more specific version of the preferred embodiment, the viewing side 16 of the frame 14 is imprinted with a decorative design. In yet a more specific version of the preferred embodiment, the viewing side 16 of the frame 14 will accept an ink from the consumer to allow them to make their own design or notes.

Figure 3:
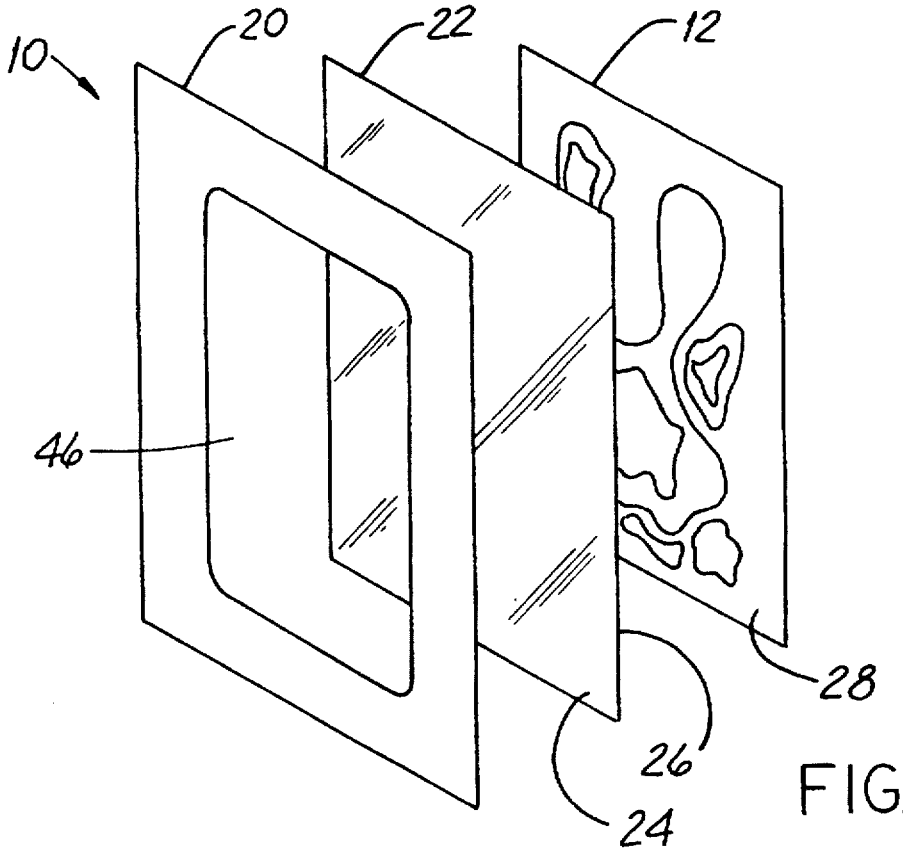
FIG. 3 is a perspective view of the device with the single-sided adhesive tape being used as the framing material.
Figure 4:
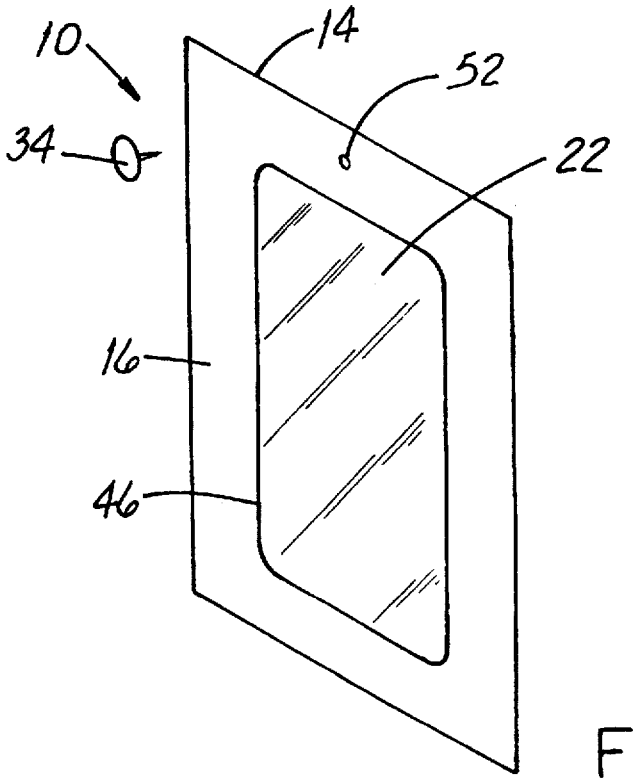
FIG. 4 is a perspective view of the device showing a tack being used to affix the frame to a surface.

In yet another preferred embodiment of the invention, as shown in FIG. 3, a sheet of single-sided tape 20 having an adhesive surface is used to form the frame 12. This tape 26 may also have some decorative design or color such as gold, silver or white on its viewing side. In this embodiment, a layer of static-cling film 22 having first 24 and second 26 surfaces is positioned so that the first surface 24 of the film 22 is in contact with the adhesive surface of the tape 20. The article 12 being framed is oriented so that its display face 28 adheres to the second surface of the film 26. In such embodiment, the tape 20 has a central aperture 46 therethrough. Once the article 12 is framed, should the viewing side of the tape 20 have a light colored surface, such as white, a child or any other individual could use some type of pen, crayon or marker and personally decorate the viewing side of the tape 20 that forms the frame.

Another aspect of the invention involves a method for framing articles including photographs, certificates and the like. Such method includes the steps of providing (a) a sheet-like framing material 14 having a viewing side 16 and a reverse side 18, (b) a sheet of pressure-sensitive single-sided tape 20, (c) a sheet of static-cling film 22 having first 24 and second 26 surfaces, and (d) an article 12 having a display face 28. The framing of the article 12 is accomplished by applying the tape 20 to the reverse side 18 of the framing material 14. This is followed by cutting center apertures 46 in both the framing material 14 and the tape 20. Once this is done, the first surface 24 of the film 22 is attached to the tape 20. Finally, the display face 28 of the article 12 is affixed to the second surface 26 of the sheet of static-cling film 22.

A specific embodiment of such method includes the step of attaching a strip of double-sided tape 30 to the second surface 26 of the film 22 thereby enabling the device 10 to adhere to a textured or cement surface. In another, more specific embodiment of the method, a tack 34 is attached through the frame 14 to enable the device 10 to adhere to a papered surface.

In a preferred method of framing, the sheet of static-cling film 22 with a liner 40 attached to its second side 26 is a first sheet. Such film 22 may have solid ink printing on its first side 24 forming a frame. In such embodiment, the article 12 has a reverse face 36, and the affixing step is followed by providing a second sheet of static-cling film 38 having a first 42 and second 44 surface with a liner 40 joined to the second surface 44 of the second sheet of film 38. In this method, the first surface 42 of the second sheet of cling-free film 38 is appended to the reverse face 36 of the article 12 to be framed. Once this is done, the liner 40 is then removed from the second surface 44 of the second sheet of film 38.

In yet another preferred embodiment of the invention, a strip of double-sided tape 30 can be applied to the second surface 44 of the second sheet of film 38, thereby enabling the device 10 to adhere to a textured or cement surface. In a more specific embodiment, a tack 34 can be attached through the frame 14 to enable the device 10 to adhere to a papered surface.

Figure 7:
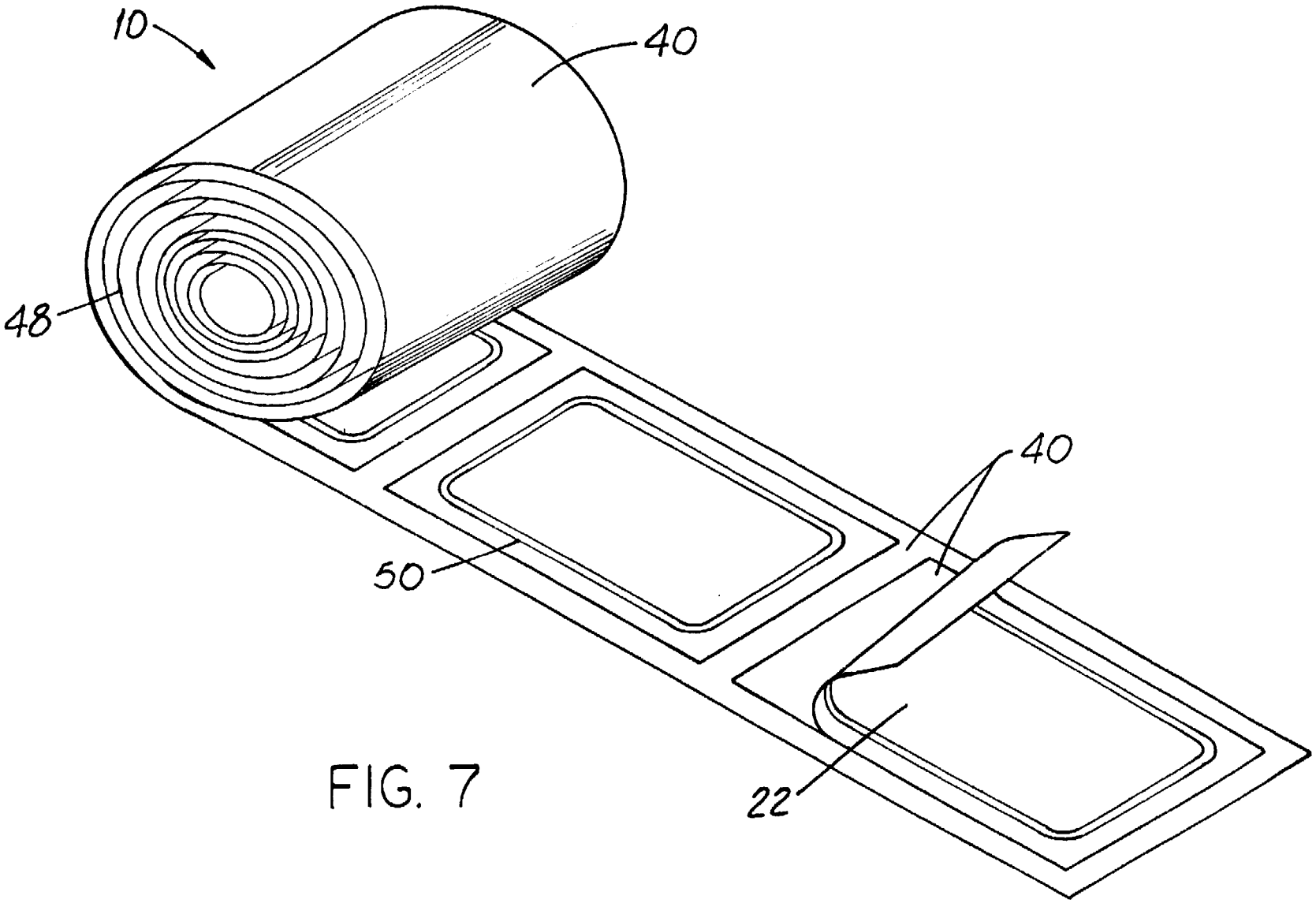
FIG. 7 is a perspective of a roll of a sheet of static-cling film with a liner attached to its second side and a frame etched to its first side.

Still another preferred method recognizes that devices 10 for framing may be put up in bulk, roll form and dispensed from a roll 48 for retail sale. The method includes the step of providing (a) a sheet of static-cling film 22 having a first 24 and a second 26 surface, (b) a liner 40, and (c) an article 12 to be framed having a display face 28. In this method, framing is accomplished by attaching the liner 40 to the second surface 26 of the film 22. This is followed by etching the outline of a frame on the first surface 24 of the film 22 and then imprinting a design 50 or solid color on the frame, as shown in FIG. 7. This imprinting is followed by rolling the sheet of film 22 with the liner 40 attached into a roll 48. The rolling step is followed by "paying out" the film 22 and liner 40 from the roll 48, cutting the film 22 away from the roll 48, peeling the frame away from the liner 40, and affixing the display face 28 of the article 12 to the second surface 26 of the film 22. This rolling of the film 22 and liner 40 together allows for a plurality of frames to be included in one roll 48.

Depending upon the nature of the display site, such framing method may be followed by the step of adhering a strip of double-sided tape 30 to the second surface 26 of the film 22 thereby enabling the device 10 to adhere to a textured or cement surface. Or the user may attach a tack 34 through the film 22 to enable the device 10 to adhere to cork or to a papered surface, e.g., drywall.

This method of framing can be accomplished for individual units. In such instance, the material can be made available in individual die cut pieces together with the liner 40 attached until the user is ready to apply the article 12 to the static-cling film frame 22.

Another preferred method of framing articles involves providing (a) a sheet of pressure-sensitive single-sided tape 20, (b) a sheet of static-cling film 22 having first 24 and second 26 surfaces, and (c) an article 12 having a display face 28. This method involves cutting a center aperture 46 in the tape 20, attaching the first surface 24 of the film 22 to the tape 20, and affixing the display face 28 of the article 12 to the second surface 26 of the sheet of static-cling film 22. In a specific version of this embodiment, a strip of double-sided tape 30 is attached to the second surface 26 of the film 22 thereby enabling the device 10 to adhere to a textured or cement surface. In a more specific version of such embodiment, a tack 34 is attached through the frame thereby enabling the device 10 to adhere to a papered surface.

This specification uses the terms "single-sided" and "double-sided" in reference to tape 30. Such terms are understood in the relevant industry to mean and are used in this specification to mean, respectively, tape having adhesive on only one side and tape having adhesive on both sides. As used herein, the term "tape" means, depending upon the context, a thin strip of material having length substantially greater than width or a thin sheet of material having length and width which are generally similar.

Static-cling film 22 is thin, highly-flexible, transparent, free of adhesive and "clings" to a surface by virtue of difference in static electrical charge. A suitable static-cling film is sold under the brand name Stuck Up® Frames.

While the principles of the invention have been shown and described in connection with a few embodiments, it is to be understood clearly that such embodiments are by way of example and are not limiting.

What is claimed:

1. A device for framing articles such as photographs, and certificates, the device being comprised of:

a sheet-like frame having a first, viewing side and a second, reverse side;

single-sided tape adhering to the reverse side of the frame;

a layer of static-cling film having first and second surfaces, the first surface being in contact with the tape; and an article having a display face adhering to the second surface of the film.

2. The device of claim 1 wherein the frame and tape have a central aperture therethrough.

3. The device of claim 1 wherein the frame and tape have a pre-cut center which is later removed to form an aperture.

4. The device of claim 1 wherein double-sided adhesive tape is attached to the second surface of the film, thereby enabling the device to adhere to a textured surface.

5. The device of claim 1 wherein a tack is attached through the frame thereby enabling the device to adhere to a papered surface.

6. The device of claim 1 wherein:

the article has a reverse face;

the layer of static-cling film is a first layer;

the device includes a second layer of static-cling film having a first surface adhering to the reverse face of the article.

7. The device of claim 6 wherein the second layer of film has a second surface and a double-sided adhesive tape is attached to the second surface of the second layer of film, thereby enabling the device to adhere to a textured surface.

8. The device of claim 6 wherein a tack is attached through the frame thereby enabling the device to adhere to a papered surface.

9. The device of claim 1 wherein the viewing side is imprinted with a design.

10. A device for framing articles including photographs, the device being comprised of:

a sheet of single-sided tape having an adhesive surface and a central aperture through the sheet;

a layer of static-cling film having first and second surfaces, the first surface of the film being in contact with the adhesive surface of the tape; and an article having a display face adhering to the second surface of the film.

11. A device for framing articles including photographs, the device being comprised of:

a sheet of single-sided tape having an adhesive surface and a pre-cut center which is later removed to form an aperture;

a layer of static-cling film having first and second surfaces, the first surface of the film being in contact with the adhesive surface of the tape; and an article having a display face adhering to the second surface of the film.

12. The device of claim 1 wherein double-sided adhesive tape is attached to the second surface of the film, thereby enabling the device to adhere to a cement surface.

13. The device of claim 6 wherein the second layer of film has a second surface and a double-sided adhesive tape is attached to the second surface of the second layer of film, thereby enabling the device to adhere to a cement surface.

* * * * *